US005118198A

United States Patent [19]

Whiteman, Jr.

[11] Patent Number: 5,118,198

[45] Date of Patent: Jun. 2, 1992

[54] CEMENT MIXING APPARATUS WITH CRADLE SUPPORT ASSEMBLY

[76] Inventor: Marvin E. Whiteman, Jr., 2254 Braniff St., Boise, Id. 83706

[21] Appl. No.: 534,544

[22] Filed: Jun. 7, 1990

[51] Int. Cl.[5] ..... B28C 5/26; B28C 7/16

[52] U.S. Cl. ..... 366/47; 248/142; 366/57; 366/62; 366/63; 366/185; 366/228

[58] Field of Search ..... 366/47, 48, 57, 62, 366/63, 60, 45, 46, 56, 54, 55, 185, 189, 225, 228, 232; 220/605, 608, 660, 675, 401; 248/130, 131, 137, 141, 142, 132, 133, 139, 140

[56] References Cited

U.S. PATENT DOCUMENTS

| | | | |
|---|---|---|---|
| 1,621,345 | 3/1927 | Anderson | 366/47 |
| 1,693,935 | 12/1928 | Nelles | 366/232 X |
| 1,714,602 | 5/1929 | Jaeger et al. | 366/47 |
| 2,453,583 | 11/1948 | Muller | 366/47 |
| 2,482,976 | 9/1949 | Harwood | 366/45 |
| 2,494,118 | 1/1950 | Essick | 366/47 |
| 2,494,119 | 1/1950 | Essick | 366/45 |
| 2,499,052 | 2/1950 | Brookins | 366/47 |
| 2,801,085 | 7/1957 | Maxon, Jr. | 248/139 X |
| 2,944,799 | 7/1960 | Larson | 366/57 |
| 2,956,790 | 10/1960 | Moriya | 366/47 |
| 3,768,785 | 10/1973 | Susemihl | 366/47 |
| 4,143,973 | 3/1979 | Hauser | 366/54 |
| 4,435,082 | 3/1984 | Bishop | 366/47 |
| 4,491,415 | 1/1985 | Bishop | 366/47 |
| 4,521,116 | 6/1985 | Adsit | 366/54 |
| 4,634,284 | 1/1987 | Bishop | 366/47 |
| 4,750,840 | 6/1988 | Bishop | 366/54 |
| 4,756,623 | 7/1988 | Bishop | 366/57 |

FOREIGN PATENT DOCUMENTS

| | | | |
|---|---|---|---|
| 130232 | 6/1947 | Australia | 366/47 |
| 943457 | 5/1956 | Fed. Rep. of Germany | 366/47 |
| 2215961 | 10/1973 | Fed. Rep. of Germany | 366/47 |
| 938507 | 10/1963 | United Kingdom | 366/46 |
| 2032793 | 5/1980 | United Kingdom | 366/46 |
| 2223182 | 4/1990 | United Kingdom | 366/62 |

*Primary Examiner*—Harvey C. Hornsby
*Assistant Examiner*—C. Cooley
*Attorney, Agent, or Firm*—Frank J. Dykas; Craig M. Korfanta; Ken J. Pedersen

[57] ABSTRACT

An improved cement mixer having polyethylene cement mixing drum (20) held and supported by a cradle arm assembly (21) formed of cradle base support braces (23) and upright cradle arms (22) which interfit into crandle arm recesses (27) which are preformed with polyethylene drum (20). A bull gear (25) is provided and circumvolves polyethylene drum (20). Bull gear (25) is aligned with and attached to cradle arms (22) and drum (20) so they dual function both as a drive mechanism for rotating drum (20) and as a structural member for cradle assembly (21).

19 Claims, 9 Drawing Sheets

CEMENT MIXING APPARATUS WITH CRADLE SUPPORT ASSEMBLY

BACKGROUND OF THE INVENTION

1. Technical Field

This invention generally relates to driven, trailerable, cement mixer having an integral polyethylene cement mixing drum.

2. Background Art

It has been well known for a number of years that cement does not readily adhere to most polymer surfaces, and in particular to polyethylene materials. It has been well known for a much longer period of time that cement will readily adhere to steel and other metallic surfaces, particularly if the coefficients of expansion and contraction are similar. Yet given this knowledge, cement mixers of any reasonable capacity have always utilized steel mixing drums as opposed to polyethylene which is one of the strongest polymer materials. Only the smallest capacity cement mixers have been able to take advantage of the desirable characteristics inherent to a polyethylene mixing drum, primarily because of the forces that need be imparted to a polyethylene drum in order to rotate it, when it contains anything more than a few cubic feet of cement, exceed the strength limitations of a polyethylene drum resulting in either deformation of the drum, or a parting of the drum from its mechanical turning mechanism. As a result, the use of polyethylene drums for cement mixers is generally restricted to hand operated, small capacity, cement mixing devices. Examples can be found in Bishop U.S. Pat. Nos. 4,491,415, 4,634,284 and 4,750,840.

As the capacity of the cement mixer is increased, the need for structural strength for the drum increases and as a result, in order to take advantage of the non-stick Properties of polyethylene, manufactures of cement mixers have resorted to the use of polyethylene liners held within a steel drum. An example of this design can be seen in Adsit, U.S. Pat. No. 4,521,116.

Cement mixers having steel drums without a liner must be carefully and promptly cleaned after each use to prevent the buildup of dried cement within the drum. This is a time consuming and often neglected task. Failure to clean the drum promptly and completely results is a drastically shortened life for the drum. As a result, replacement drums must be periodically installed in trailerable, powered cement mixers in the four to twelve cubic feet capacity range.

Even the use of the polyethylene liner is, in and of itself, not an entirely satisfactory solution since it must still be promptly cleaned before the cement residue dries. The reason for this is that, once the residue dries on the polyethylene surface, it has to be either scrapped off or jarred loose. The easiest way to remove the dried cement residue is to jar it loose by striking a blow to the drum, which usually results in the dried cement separating from the surface of the polyethylene drum and coming to rest as a pile of cement powder at the bottom of the drum. This powder can then be quickly and easily dumped from the drum. Even in situations where the interior surfaces of the polyethylene drum liner are promptly cleaned, the residue will collect and adhere to the bottom surface of the drum liner. However, if the polyethylene liner is encased within a metal outer shell, a blow to the outer shell with a hammer or other heavy object to jar the dried cement residue loose will dent and permanently deform the metal drum shell, which defeats the purpose of using the polyethylene liner in the first place. Thus, if the dried cement residue is located at the bottom of the drum, it is almost invariably in a location where the drum liner is totally encased within the metal shell. As a result the cement mixers in the four to twelve cubic foot capacity range being manufactured today are still formed with conventional steel cement mixing drums.

Accordingly, it is an object of this invention to provide a powered, trailerable, cement mixer with a capacity of between four and ten cubic feet which utilizes a polyethylene cement mixing drum having all of its surfaces, including the base of the drum, exposed or otherwise not encased within a steel or other metal type shell.

A second object of the present invention is to provide for polyethylene mixing blades and shovels as opposed to blades and shovels formed of metal, attached within the mixing drum.

DISCLOSURE OF INVENTION

These objects are achieved by providing a cement mixer having a conventional base frame with attached forward and rear standards and an engine for powering a pinion drive gear. A cement mixing drum, formed of polyethylene material, having preformed cradle arm recesses integrally formed in the sides of the drum, is held within a cradle assembly formed of a plurality of base cross braces. Extending up from the ends of each of the cross braces are upright cradle arms which interfit within the cradle arm recesses. A bull gear is attached to and circumvolves the drum and interlocks with the top of the upright cradle arms to form a cradle assembly for holding the polyethylene cement mixing drum.

Extending down and located coincident to the central axis of rotation for the drum, the base cross braces of the cradle arm assembly is a spindle shaft. The spindle shaft is in turn rotatably attached by means of thrust bearings to a base frame member of a tiltable yoke assembly.

The bull gear, circumvolving the drum, is also in intermeshing engagement with the teeth of the drive pinion gear, and provides a means of rotating the polyethylene cement mixing drum and its attached cradle arm assembly, about the shaft spindle. The yoke assembly is rotatably mounted to forward and rear standards.

A hand wheel, shaft and a dump pinion gear assembly are provided to engage a dump gear attached to the forward Yoke shaft, to provide a means for tilting the yoke assembly and the attached cradle arm assembly and polyethylene drum from the upright mixing position, to a dumping position on either side of the cement mixer.

BEST MODE FOR CARRYING OUT INVENTION

Figure 1:
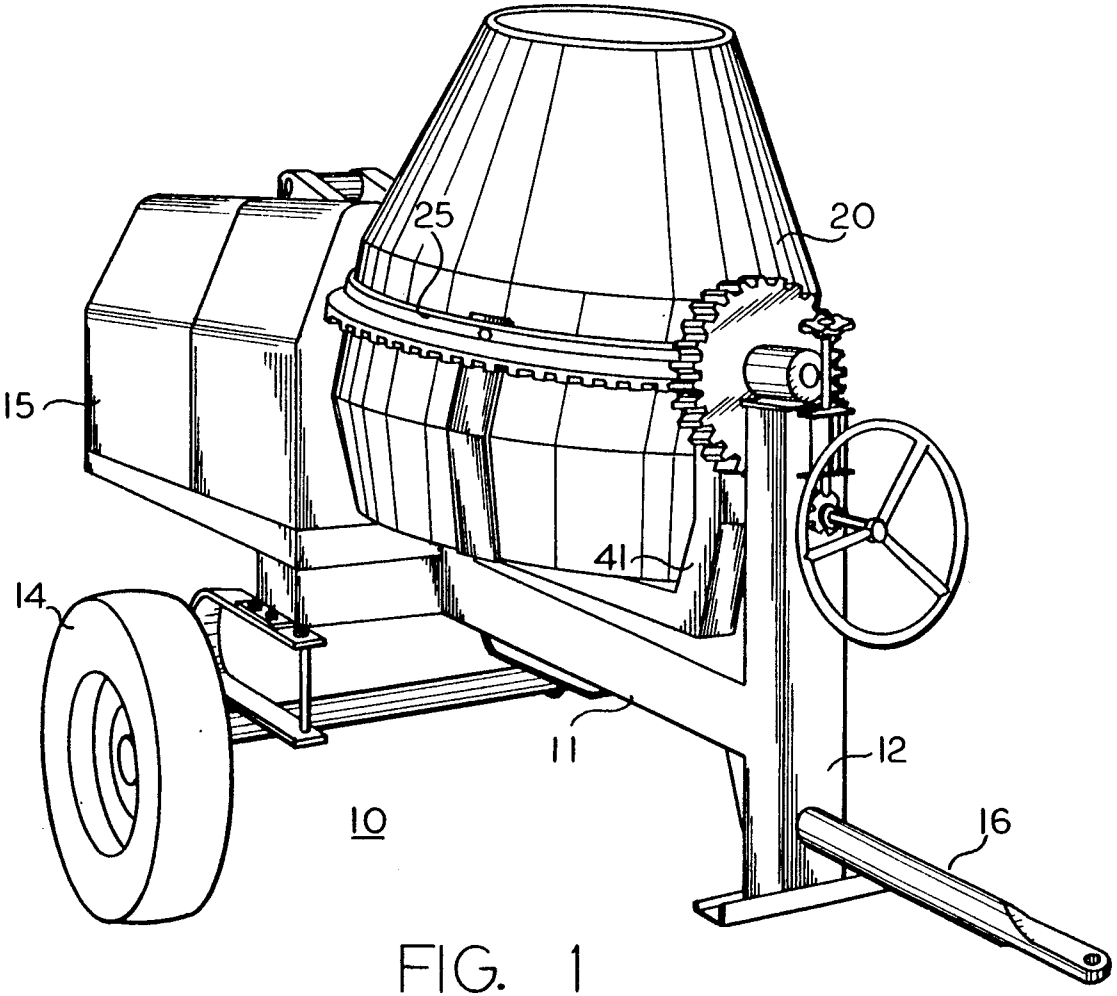
FIG. 1 is a perspective representational view of the trailerable, power driven, cement mixer.
Figure 2:
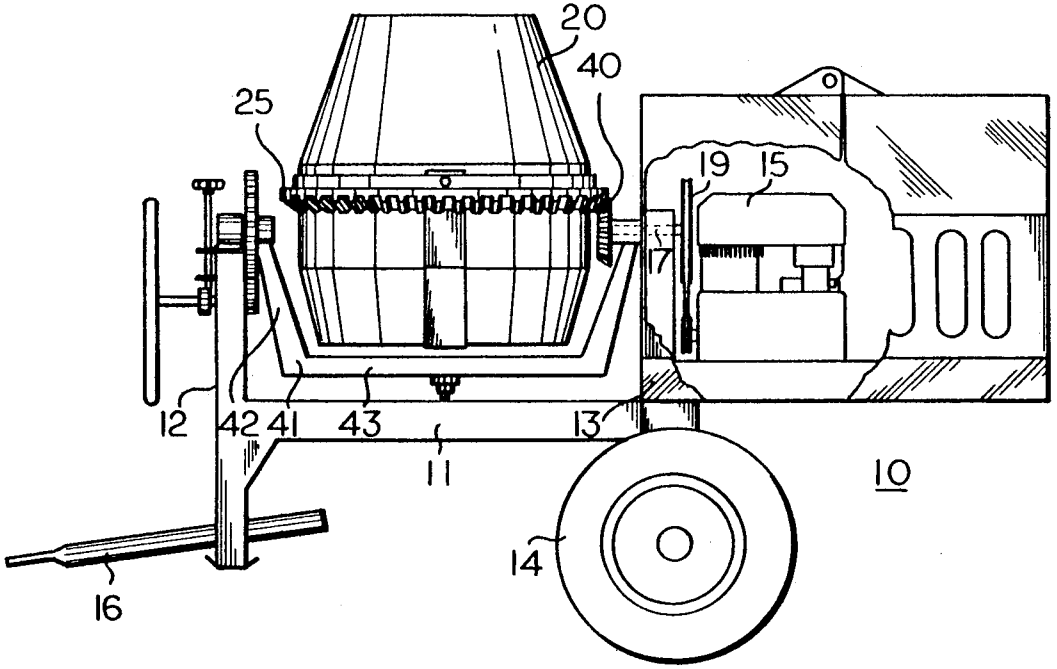
FIG. 2 is a sectional side view of the trailerable, power driven, cement mixer.
Figure 3:
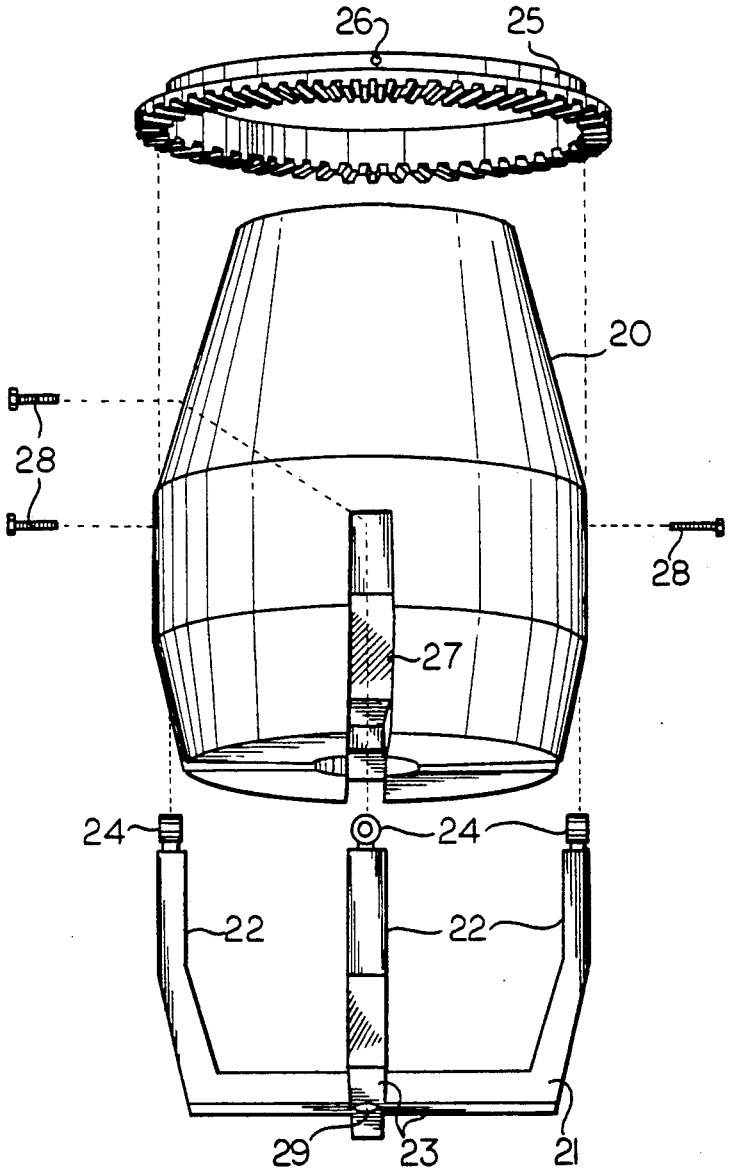
FIG. 3 is an exploded perspective representational view of the polyethylene drum and cradle assembly.
Figure 4:
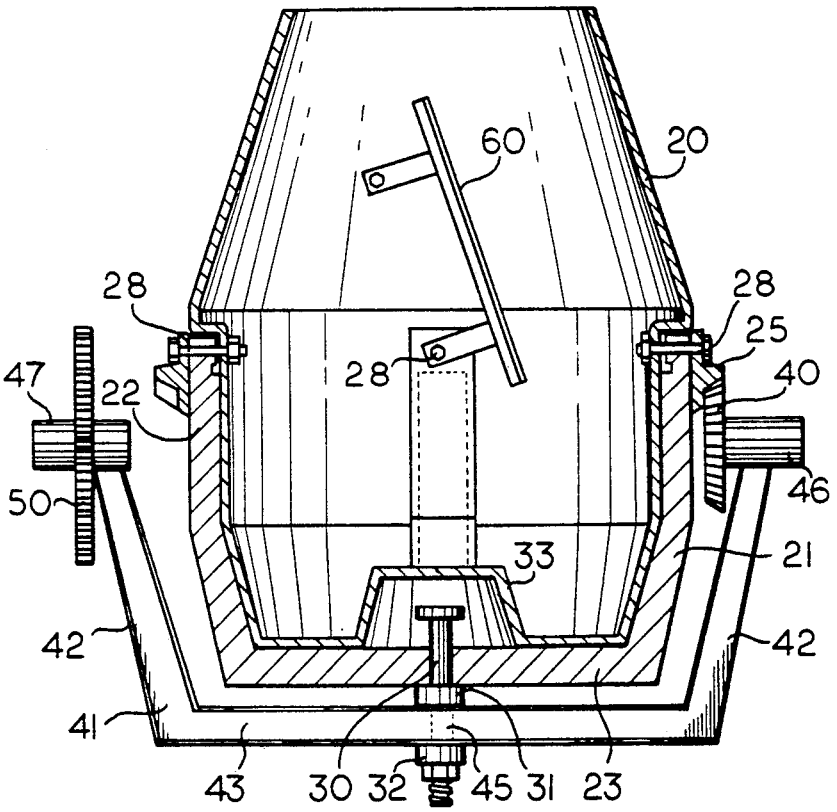
FIG. 4 is a sectional side view of the polyethylene drum, cradle and yoke assembly.
Figure 5:
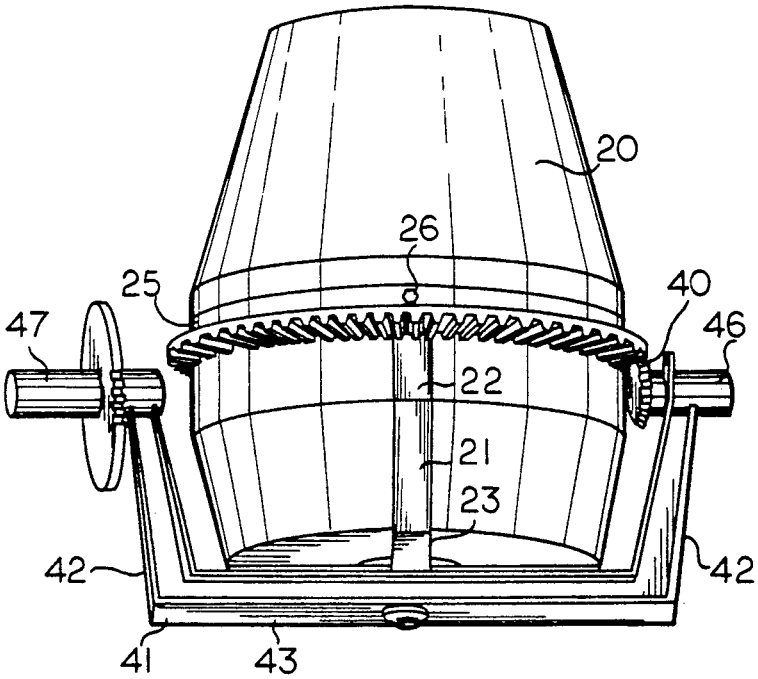
FIG. 5 is a perspective representational view of the assembled drum, cradle and yoke assembly.

The major components of my new trailerable powered cement mixer 10 utilizing a polyethylene drum 20 is shown in FIGS. 1 and 2, and the polyethylene drum assembly is shown in greater detail in FIGS. 3, 4 and 5. The unit includes main frame member 11, attached front standard 12 and rear standard 13, which together support yoke assembly 41 which is formed of yoke upright members 42 and yoke base 43.

Tongue 16 and wheel and axle assembly 14 are provided for trailering the unit to various locations of use. The drive shaft of engine assembly 15 is coupled to reduction pulley 19 by means of conventional drive belts, for turning bull gear 25 to provide for powered rotation of polyethylene drum 20.

As stated in the background section of this specification, one of the primary problems associated with the use of a polyethylene drum for a cement mixer having a capacity of between four and ten cubic feet, is the structural weaknesses inherent to polyethylene, and the resulting requirement of a supportive metal shell which, in large part, defeats the purpose of using polyethylene material in a cement mixer. This inherent design problem is overcome by the cradling frame system as shown in FIGS. 3, 4 and 5 which provides the necessary structural strength for a cement mixer of this capacity range, yet still exposes the outer surfaces of polyethylene drum 20 such that it can be easily hammered upon or otherwise struck so as to jar loose dried cement residue adhering to the interior surface of drum 20.

Referring now to FIGS. 3, 4 and 5, cradle assembly 21 has cradle base support braces 23 integrally formed or welded together so as to provide a base support having a spindle shaft hole 29 located at the center point of the intersection of cradle support bars 23, coincident to the central axis of rotation of drum 20. Attached to cradle support bars 23 are generally upright cradle arms 22 which are sized and shaped to closely conform to and interfit within cradle arm recesses 27 which are integrally formed into the sides of polyethylene drum 20 at the time of its fabrication.

As shown and described in this preferred embodiment, there are four upright cradle arms 22 attached to the end points of two cradle support bars 23. It should be apparent that in cases of a larger capacity cement mixer, more cradle arms 22 and support bars 23 will be provided to insure adequate strength and support for mixing drum 20.

Bull gear 25 is sized to circumvolve the outer perimeter of polyethylene drum 20 and to intermesh with drive pinion gear 40 which, as previously stated, is driven by enqine assembly 15, thus providing a means of rotating polyethylene drum 20 around its central longitudinal axis.

At the upper end of each of cradle arms 22 is attached a bolt hole journal eyelet 24 which, when cradle arms 22 are interfitted into cradle arm recesses 27, align with bolt holes in polyethylene drum 20. Bull gear 25 has similarly aligned bull gear bolt holes 26, which when bull gear 25 is positioned to circumvolve polyethylene drum 20 at the location of bolt hole journal eyelets 24, will align to enable the assembly to be bolted together using retaining bolts 28. In this manner, bull gear 25 serves a dual function both as a drive mechanism for rotating drum 20 and, as a structural member for cradle assembly 21.

Figure 6:
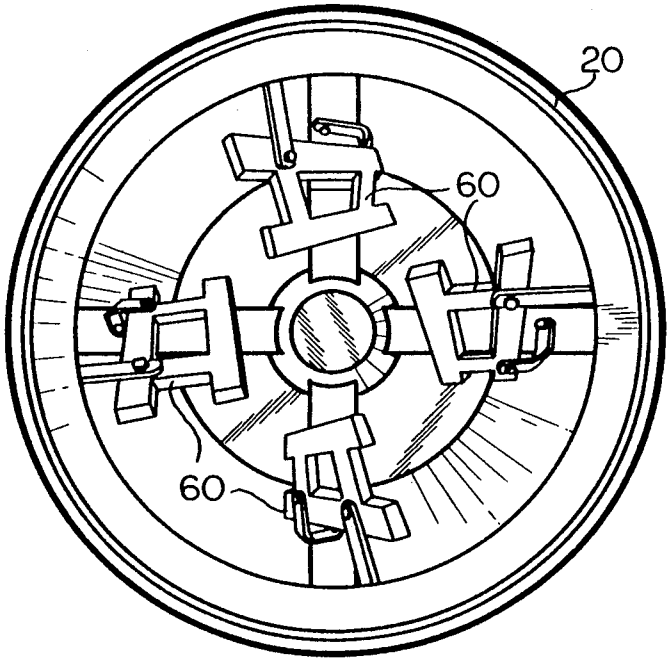
FIG. 6 is a top view of the drum opening showing the interior of the drum and assembled mixing blades.
Figure 7:
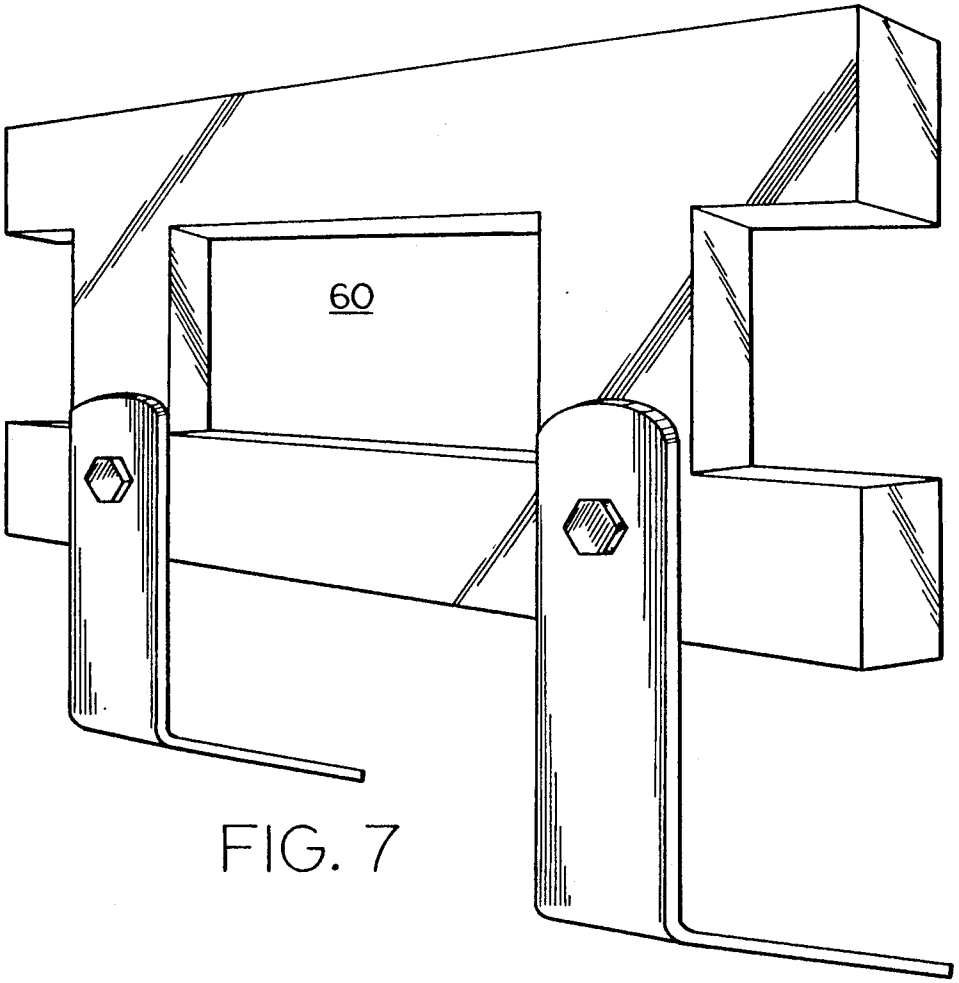
FIG. 7 is a perspective representational view of the mixing blade.

As shown in FIGS. 6 and 7, mixing blade assemblies 60 are attached to the interior surfaces of polyethylene drum 20 to provide for mixing of cement, water, sand and aggregate, when drum 20 is rotated. As shown in FIGS. 4 and 6, mixing blade assembly 60 is bolted to the interior surface of polyethylene drum 20, with the lower attachment point being made to retaining bolts 28 which also hold bull gear 25 and cradle arm assembly 21 together, thus providing a firm, solid attachment point for mixing blade assembly 60. In practice it has been found sufficient to merely bolt the upper retaining arm of paddle blade assembly 60 directly to the polyethylene drum 20 at an unreinforced point.

In keeping with the primary object of the present invention, mixing blade assemblies 60 are also formed of non-stick polyethylene material so as to provide the same desirable non-stick characteristics and the ability to jar loose any adhering cement residue.

As shown in FIGS. 4 and 5, the entire assembly of cradle arms 22 cradle support bars 23, bull gear 25, polyethylene drum 20, and mixing blade 60, is supported for axial rotation around the centerline longitudinal axis of mixing drum 20 by means of spindle thrust bearing 31 and lower spindle bearing 32 attached to spindle shaft 30 which is attached to the cradle assembly and extends through spindle shaft hole 29 located at the center point of the intersection of cradle support bars 23 as shown in FIG. 3. Spindle thrust bearing 31 rests atop and is attached to yoke base 43 of barrel yoke assembly 41 and is the point where all of the weight of the drum assembly and the materials to be mixed is transferred from the drum ultimately to forward standard 12 and rear standard 13.

As shown in FIGS. 2, 4 and 5, yoke assembly 41 is formed of yoke base 43, and upwardly extending yoke upright members 42 which have attached at the front end of the assembly yoke dump gear shaft journal bearing assembly 47 and at the rear, yoke drive shaft journal bearing assembly 46, both of which are designed to hold rotatable shafts and to serve as the transfer points for the weight of the drum assembly, and its contents, which has been transferred to yoke assembly 41 at the point where pinion gear thrust bearing 31 is attached to yoke base 43.

Figure 8:
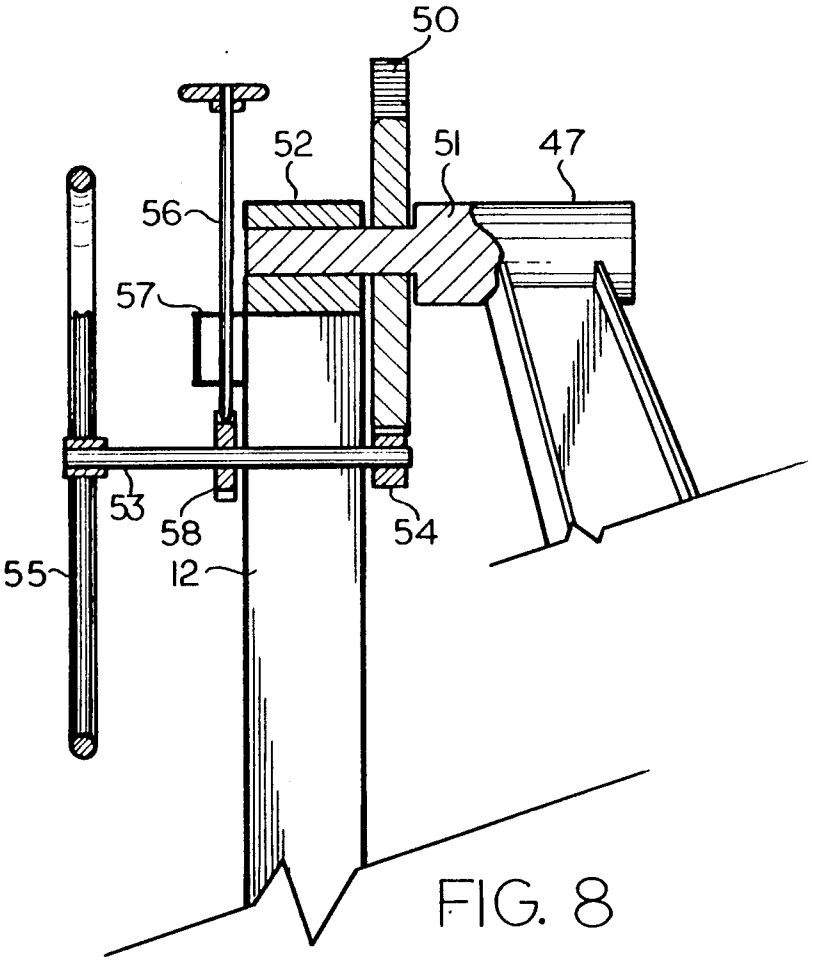
FIG. 8 is a sectional side view of the drum dump assembly.
Figure 9:
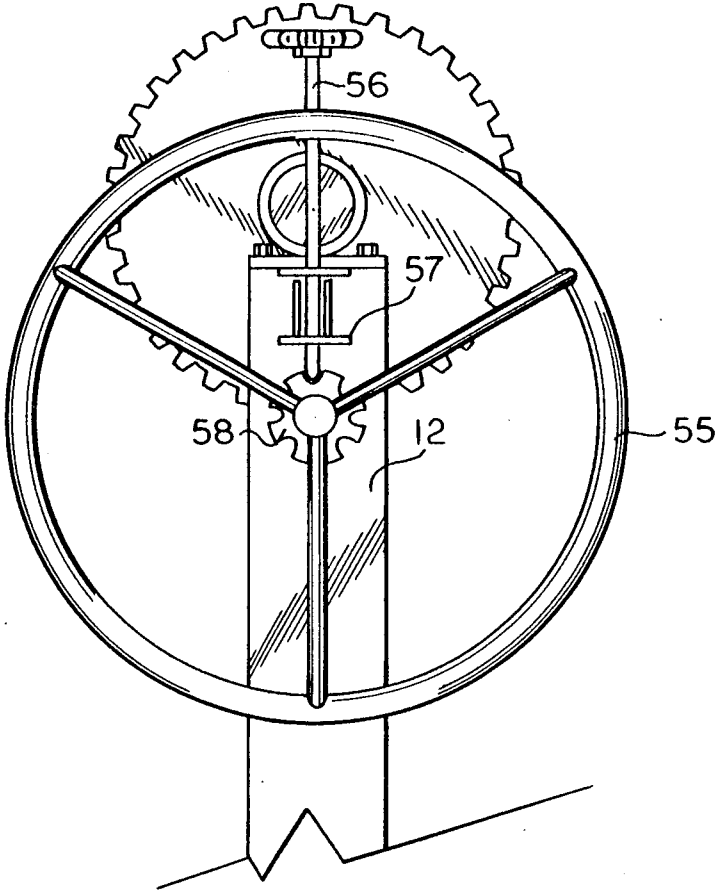
FIG. 9 is a front view of the drum dump assembly.

As shown in FIGS. 2, 4 and 5, drive shaft 17, receiving power by belts rotating reduction pulley 19, drives pinion gear 40 which in turn rotates bull gear 25 about the central axis of drum 20. At the opposite end of yoke assembly 41, as shown in FIGS. 8 and 9, dump gear shaft 51 is provided to rotatably interconnect between yoke dump gear shaft journal bearing assembly 47 and dump gear journal bearing 52 which is attached to forward standard 12 and thus provides a means of transferring weight to forward standard 12. Attached to dump gear shaft 51 for axial rotation with shaft 51 is dump gear 50. The purpose of dump gear 50 is, when it is rotated at a mechanical advantage, that it will rotate yoke assembly 41 and the attached polyethylene drum assembly from an upright mixing position to a tilted, dump position for dumping the contents of drum 20. This is accomplished by means of turning dump hand wheel 55, thereby imparting rotation by means of dump pinion shaft 53 and its attached dump pinion gear 54 which intermeshes with the gear teeth of dump gear 50 to impart rotation.

Also as shown in FIGS. 8 and 9, a latching mechanism is provided to enable the operator to hold yoke assembly 41 and polyethylene drum 20 in any of a number of tilted orientations ranging from upright to a dumping position on either side of cement mixer assembly 10. As can be seen in FIGS. 8 and 9, dump lock gear 58 is attached to dump pinion shaft 53, and rotates with dump pinion shaft 53 to bring any one of a plurality of notches in dump lock gear 58 into alignment with dump latch 56 which is held within latch slide bracket 57 attached to forward standard 12. By manually pulling up dump latch 56 to disengage it from a notch in dump lock gear 58, the operator is free to rotate dump hand wheel 55 to reorient drum 20. Engaging dump latch 56 within a notch of dump lock gear 58 of course locks the yoke in a orientation selected by the operator.

The use of cradle arm assembly 21, and the interlocking bull gear 25, provides for a structural support system for polyethylene drum 20 yet still leaves significant portions of the base and lower side walls of polyethylene drum 20 exposed where they can be easily struck to jar loose adhering dried cement residue.

While there is shown and described the present preferred embodiment of this invention, it is to be distinctly understood that this invention is not limited thereto but may be variously embodied to practice within the scope of the following claims:

I claim:

1. An improved cement mixer having a base frame with attached forward and rear standards, a bull gear, a pinion drive gear, power means for rotating the pinion drive gear, with said pinion drive gear being engaged with the bull gear, wherein the improvement comprises:

a cement mixing drum having an open top, sides and a base defining an interior volume and further having a central rotational axis, said cement mixing drum being formed of a polymer material to which concrete will not readily adhere;

said bull gear attached to and circumvolving said drum and in intermeshing engagement with the pinion drive gear for rotating said drum about its central rotational axis;

a cradle assembly for supporting said drum being attached to said drum and having a plurality of cradle support bars for engagement with only a portion of the base of said drum for supporting said drum, and a plurality of cradle arms attached to and extending upwardly from at least some of said cradle support bars, said cradle arms being in proximity and conformity with the sides of the drum with at least one of said cradle arms being attached to a side of the drum, and at least one of said cradle arms being attached to the bull gear;

a yoke assembly for rotatably supporting the drum and the cradle assembly, said yoke assembly being pivotally attached to the forward and rear standards; and a spindle shaft attached to said cradle assembly and coincident to the rotational axis of the drum, and rotatably attached to the yoke assembly.

2. The improved cement mixer of claim 1 which further comprises a plurality of mixing paddles attached to and extending radially into the interior volume of said drum.

3. The improved cement mixer of claim 2 wherein said drum is formed of polyethylene material.

4. The improved cement mixer of claim 3 wherein said blades are formed of polyethylene material.

5. The improved cement mixer of claim 1 wherein said drum is formed of polyethylene material.

6. An improved cement mixer having a base frame with attached forward and rear standards, a bull gear, a pinion drive gear, power means for rotating the pinion drive gear, with said pinion drive gear being engaged with the bull gear, wherein the improvement comprises:

a cement mixing drum having an open top, sides and a base defining an interior volume and further having a central rotational axis, said cement mixing drum being formed of a polymer material to which concrete will not readily adhere;

said bull gear attached to and circumvolving said drum and in intermeshing engagement with the pinion drive gear for rotating said drum about its central rotational axis;

a cradle assembly for supporting said drum being attached to said drum and having a cradle support brace for engagement with only a portion of the base of said drum for supporting said drum, and a plurality of cradle arms attached to and extending upwardly from said cradle support brace, said cradle arms being in proximity and conformity with the sides of the drum with at least one of said cradle arms being attached to a side of the drum, and at least one of said cradle arms being attached to the bull gear;

a yoke assembly for rotatably supporting the drum and the cradle assembly, said yoke assembly being pivotally attached to the forward and rear standards; and a spindle shaft attached to said cradle assembly and coincident to the rotational axis of the drum, and rotatably attached to the yoke assembly.

7. The improved cement mixer of claim 6 which further comprises a plurality of mixing paddles attached to and extending radially into the interior volume of said drum.

8. The improved cement mixer of claim 7 wherein said mixing paddles are formed of polyethylene material.

9. The improved cement mixer of claim 6 wherein said drum further includes a plurality of cradle arm recesses formed integral with said drum for receiving, in interfitting engagement, the upwardly extending cradle arms.

10. The improved cement mixer of claim 9 which further comprises a plurality of mixing paddles attached to and extending radially into the interior volume of said drum.

11. The improved cement mixer of claim 10 wherein said mixing paddles are formed of polyethylene material.

12. The improved cement mixer of claim 6 wherein said drum is formed of polyethylene material.

13. An improved cement mixer having a base frame with attached forward and rear standards, a bull gear, a pinion drive gear, power means for rotating the pinion drive gear, with said pinion drive gear being engaged with the bull gear, wherein the improvement comprises:

a cement mixing drum having an open top, sides and a base defining an interior volume and further having a central rotational axis, said cement mixing drum being formed of a polymer material to which concrete will not readily adhere;

said bull gear attached to and circumvolving said drum and in intermeshing engagement with the pinion drive gear for rotating said drum about its central rotational axis;

a cradle assembly for supporting said drum being attached to said drum and having a cradle support brace for engagement with only a portion of the base of said drum for supporting said drum, and a plurality of cradle arms attached to and extending upwardly from said cradle support brace, said cradle arms being in proximity and conformity with the sides of the drum with at least one of said cradle arms being attached to a side of the drum, and at least one of said cradle arms being attached to the bull gear;

a yoke assembly for rotatably supporting the drum and the cradle assembly, said yoke assembly being pivotally attached to the forward and rear standards; and a spindle shaft attached to said cradle assembly and coincident to the rotational axis of the drum, and rotatably attached to the yoke assembly.

14. The improved cement mixer of claim 13 which further comprises a plurality of mixing paddles attached to and extending radially into the interior volume of said drum.

15. The improved cement mixer of claim 14 wherein said mixing paddles are formed of polyethylene material.

16. The improved cement mixer of claim 13 wherein said drum further includes a plurality of cradle arm recesses formed integral with said drum for receiving, in interfitting engagement, upwardly extending cradle arms.

17. The improved cement mixer of claim 16 which further comprises a plurality of mixing paddles attached to and extending radially into the interior volume of said drum.

18. The improved cement mixer of claim 17 wherein said mixing paddles are formed of polyethylene material.

19. The improved cement mixer of claim 13 wherein said drum is formed of polyethylene material.

* * * * *